US009389574B2

(12) United States Patent
Hirakawa et al.

(10) Patent No.: US 9,389,574 B2
(45) Date of Patent: Jul. 12, 2016

(54) SOUND ABSORBING DEVICE, ELECTRONIC DEVICE, AND IMAGE FORMING APPARATUS

(71) Applicants: Kouta Hirakawa, Tokyo (JP); Junichi Murano, Saitama (JP); Shoji Asanuma, Kanagawa (JP); Toshihiro Shimada, Tokyo (JP); Tsuyoshi Endo, Kanagawa (JP); Hiroki Ishimitsu, Kanagawa (JP); Masahiro Ishida, Kanagawa (JP); Naoki Matsuda, Kanagawa (JP)

(72) Inventors: Kouta Hirakawa, Tokyo (JP); Junichi Murano, Saitama (JP); Shoji Asanuma, Kanagawa (JP); Toshihiro Shimada, Tokyo (JP); Tsuyoshi Endo, Kanagawa (JP); Hiroki Ishimitsu, Kanagawa (JP); Masahiro Ishida, Kanagawa (JP); Naoki Matsuda, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/630,789

(22) Filed: Feb. 25, 2015

(65) Prior Publication Data

US 2015/0243274 A1 Aug. 27, 2015

(30) Foreign Application Priority Data

Feb. 27, 2014 (JP) ..... 2014-037537

(51) Int. Cl.
*G03G 21/00* (2006.01)
*G10K 11/172* (2006.01)

(52) U.S. Cl.
CPC ..... *G03G 21/00* (2013.01); *G10K 11/172* (2013.01)

(58) Field of Classification Search
CPC ..... G03G 21/00; G10K 15/04; G10K 11/16; G10K 11/162; G10K 11/172
USPC ..... 399/91, 107; 181/284; 381/94
See application file for complete search history.

(56) References Cited

U.S. PATENT DOCUMENTS

| | | | | |
|---|---|---|---|---|
| 2004/0190928 | A1* | 9/2004 | Tsunoda et al. | 399/91 |
| 2008/0078611 | A1* | 4/2008 | Inoue et al. | 181/206 |
| 2008/0087019 | A1* | 4/2008 | Macquisten et al. | 60/725 |
| 2010/0171022 | A1* | 7/2010 | Fujimaki et al. | 248/559 |
| 2013/0064661 | A1* | 3/2013 | Evans et al. | 415/208.1 |

FOREIGN PATENT DOCUMENTS

| | | |
|---|---|---|
| JP | 2000-235396 | 8/2000 |
| JP | 2001-117451 | 4/2001 |

* cited by examiner

*Primary Examiner* — Sophia S Chen
(74) *Attorney, Agent, or Firm* — Harness, Dickey & Pierce, PLC

(57) ABSTRACT

A sound absorbing device including a Helmholtz resonator also includes a projection part having a shape of protruding from an outer wall surface of a communicating part forming plate among the communicating part forming plate and a cavity forming member that are cavity part forming members forming a cavity part of the Helmholtz resonator, and surrounding an opening of a communicating part that causes the cavity part to communicate with the outside.

9 Claims, 5 Drawing Sheets

SOUND ABSORBING DEVICE, ELECTRONIC DEVICE, AND IMAGE FORMING APPARATUS

CROSS-REFERENCE TO RELATED APPLICATION(S)

The present application claims priority to and incorporates by reference the entire contents of Japanese Patent Application No. 2014-037537 filed in Japan on Feb. 27, 2014.

BACKGROUND OF THE INVENTION

1. Field of the Invention

The present invention relates to a sound absorbing device including a Helmholtz resonator, and an electronic device and an image forming apparatus including the sound absorbing device.

2. Description of the Related Art

In an electrophotographic image forming apparatus, there are generated the driving sound of various driving units, the rotating sound of a polygon mirror, and the like. As a configuration that can absorb the sound generated in the image forming process, Japanese Patent Application Laid-open Nos. 2000-235396 and 2001-117451 disclose an image forming apparatus including a sound absorbing device having a Helmholtz resonator.

The Helmholtz resonator is formed of a cavity part having certain capacity and a communicating part that causes the cavity part to communicate with the outside. Assuming that a volume of the cavity part is "V", an square measure of the communicating part is "S", a length of the communicating part in a communicating direction is "H", and the velocity of sound is "c", a frequency "f" of sound absorbed by the sound absorbing device including the Helmholtz resonator is obtained through the following expression (1).

$$f = \frac{c}{2\pi}\sqrt{\frac{S}{V(H+\Delta r)}} \tag{1}$$

($\Delta r$: open end correction)

The Helmholtz resonator can absorb sound that should be prevented from being transmitted to the outside of the apparatus by setting the volume V of the cavity part, the square measure S of the communicating part, and the length H of the communicating part corresponding to the frequency of the sound that should be prevented from being transmitted to the outside of the apparatus based on the expression (1).

However, when an air current is generated around an opening of the communicating part that causes the cavity part of the Helmholtz resonator to communicate with the outside, resonance is hindered and a sound absorbing effect of the sound absorbing device including the Helmholtz resonator may be unfortunately reduced in some cases.

In view of the above-mentioned conventional problem, there is a need to provide a sound absorbing device including the Helmholtz resonator to prevents reduction in the sound absorbing effect due to the air current around the opening and efficiently absorb the sound, and the electronic device and the image forming apparatus including the sound absorbing device.

SUMMARY OF THE INVENTION

It is an object of the present invention to at least partially solve the problems in the conventional technology.

According to the present invention, there is provided a sound absorbing device including a Helmholtz resonator, the sound absorbing device comprising: a projection part having a shape of protruding from an outer wall surface of a cavity part forming member that forms a cavity part of the Helmholtz resonator and surrounding an opening of a communicating part that causes the cavity part to communicate with outside.

The present invention also provides an electronic device comprising: a sound source device that generates sound when in operation; and a sound absorber that absorbs sound, the sound absorber being the above-described sound absorbing device.

The present invention also provides an electronic device including a sound source device that generates sound when in operation and a sound absorbing device including a Helmholtz resonator, the electronic device comprising: a shape surrounding an opening of a communicating part that causes a cavity part of the Helmholtz resonator to communicate with outside.

The present invention also provides an electrophotographic image forming apparatus including the configuration of the above-described electronic device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment of an electrophotographic printer (hereinafter, simply referred to as a "printer 100") as an image forming apparatus to which the present invention is applied.

To begin with, the following describes a basic configuration of the printer 100 according to the embodiment.

Figure 2:
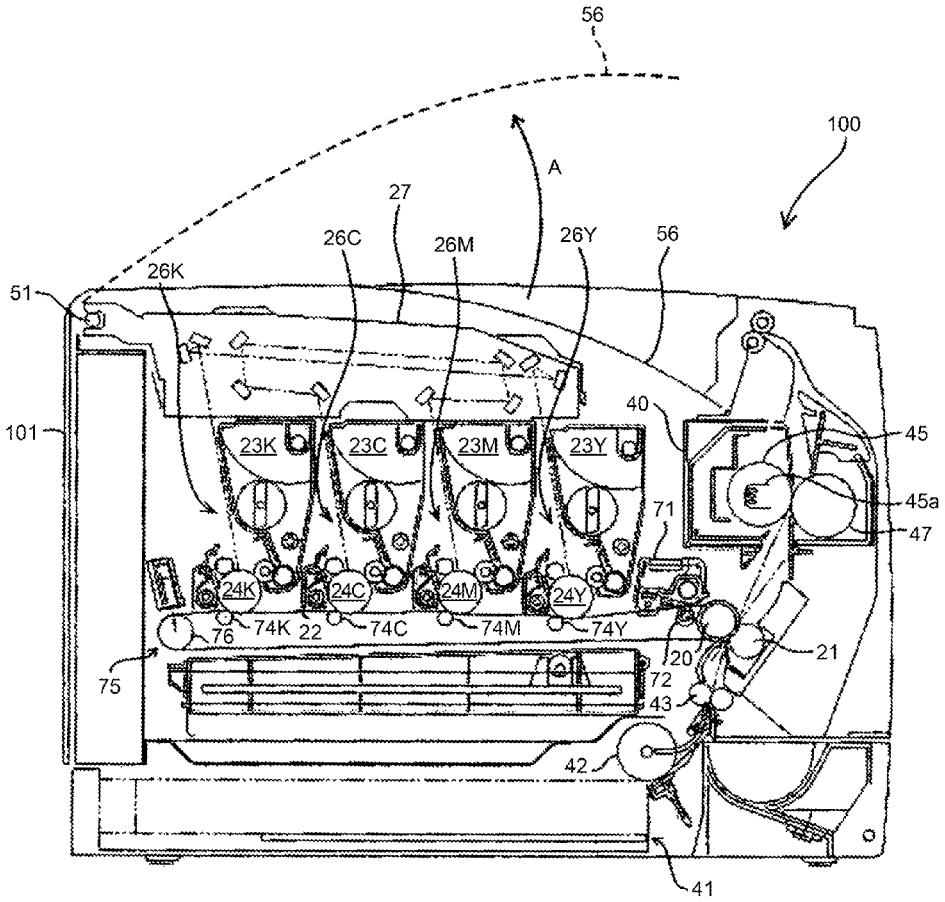
FIG. 2 is a schematic configuration diagram of the printer according to an embodiment of the present invention.

FIG. 2 is a schematic configuration diagram illustrating the printer 100. The printer 100 includes four process units 26 (black, cyan, magenta, and yellow (hereinafter, referred to as K, C, M, and Y)) for forming toner images of K, C, M, and Y. The process units 26 use toner of different colors K, C, M, and Y as image forming substances, and the other configurations thereof are the same. Such process units 26 are replaced when a service life thereof is reached.

Figure 3:
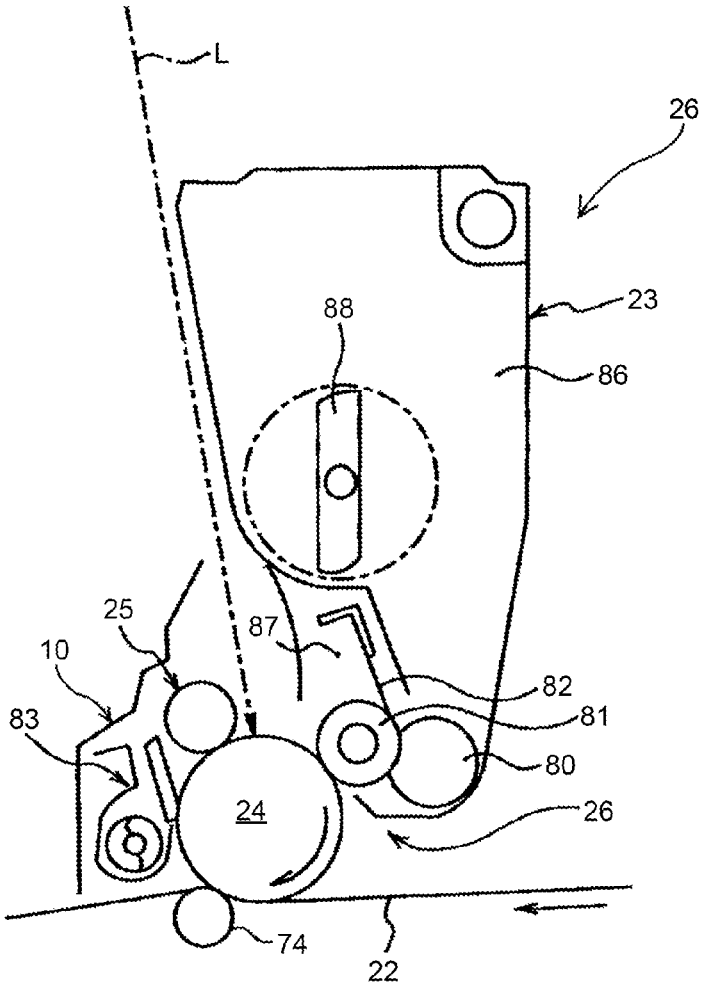
FIG. 3 is a schematic configuration diagram of a process unit in the printer.

FIG. 3 is an enlarged explanatory diagram of one of the four process units 26. The four process units 26 are the same except that colors of the toner to be used are different, so that an index (K, C, M, and Y) indicating the color of the toner to be used is omitted in FIG. 3.

As illustrated in FIG. 3, the process unit 26 includes a developing unit 23 and a photoconductor unit 10 that holds a drum-shaped photoconductor 24 serving as a latent image bearer, a photoconductor cleaning device 83, a static eliminator (not illustrated), and a charging device 25. The process unit 26 serving as an image forming unit can be attached to and detached from a main body of the printer 100, and consumable parts can be replaced at a time.

The charging device 25 uniformly charges a surface of the photoconductor 24 that is rotationally driven in a clockwise direction in the drawing by a driver (not illustrated). The uniformly charged surface of the photoconductor 24 is subjected to exposure scanning with a laser beam L, and bears an electrostatic latent image for each color. The electrostatic latent image is developed into a toner image by the developing unit 23 using toner (not illustrated), and then primary-transferred onto an intermediate transfer belt 22 described later.

The photoconductor cleaning device 83 removes residual toner after transfer adhering to the surface of the photoconductor 24 after a primary transfer process. The static eliminator eliminates a residual charge on the photoconductor 24 after cleaning. This elimination of the residual charge initializes the surface of the photoconductor 24 to prepare for the next image formation.

A cylindrical drum part of the photoconductor 24 is a hollow aluminum tube stock the front surface of which is coated with an organic photosensitive layer. The photoconductor 24 is configured such that a flange having a drum shaft is attached to each of both ends in an axial direction of the drum part.

The developing unit 23 includes a vertically oriented hopper part 86 that houses the toner serving as a developer (not illustrated) and a developing part 87. In the hopper part 86 serving as a developer housing section, arranged are an agitator 88 that is rotationally driven by a driver (not illustrated) and a toner supply roller 80 serving as a developer supplying member that is rotationally driven by a driver (not illustrated) on a vertically lower side of the agitator 88. The toner in the hopper part 86 moves toward the toner supply roller 80 under its own weight while being agitated by the agitator 88 that is rotationally driven. The toner supply roller 80 includes a metallic cored bar and a roller part made of foamed plastics and the like coated on the surface of the cored bar, and rotates while causing the toner accumulated on a lower side in the hopper part 86 to adhere to a surface of the roller part.

In the developing part 87 of the developing unit 23, arranged are a developing roller 81 that rotates while being in contact with the photoconductor 24 and the toner supply roller 80, a thinning blade 82 of which the distal end is in contact with a surface of the developing roller 81, and the like. The toner adhering to the toner supply roller 80 in the hopper part 86 is supplied to the surface of the developing roller 81 at a contact part between the developing roller 81 and the toner supply roller 80. A layer thickness of the supplied toner on the surface of the developing roller 81 is controlled when passing through a contact position between the developing roller 81 and the thinning blade 82 according to the rotation of the developing roller 81. The toner after controlling the layer thickness thereof adheres to an electrostatic latent image on the surface of the photoconductor 24 in a developing region, which is a contact part between the developing roller 81 and the photoconductor 24. This adherence causes the electrostatic latent image to be developed into a toner image.

Such a toner image is formed by each of the process units 26, and the toner image of each color is formed on each photoconductor 24 of each process unit 26.

As illustrated in FIG. 2, an optical writing unit 27 is arranged on a vertically upper side of the four process units 26. The optical writing unit 27 serving as a latent image writing device optically scans each photoconductor 24 in each of the four process units 26 with the laser beam L emitted from a laser diode based on image information. The optical scanning causes the electrostatic latent image for each color to be formed on the photoconductor 24. In such a configuration, the optical writing unit 27 and four process units 26 function as image formation units that form the toner images of K, C, M, and Y as visible images having different colors on three or more latent image bearers.

The optical writing unit 27 irradiates the photoconductor with the laser beam L emitted from a light source via a plurality of optical lenses or mirrors while polarizing the laser beam L in a main-scanning direction using a polygon mirror rotationally driven by a polygon motor (not illustrated). An optical writing unit may be adapted that performs optical writing using LED light emitted from a plurality of LEDs of an LED array.

On a vertically lower side of the four process units 26, arranged is a transfer unit 75 serving as a belt device that stretches and endlessly moves an endless intermediate transfer belt 22 in a counter-clockwise direction in the drawing. The transfer unit 75 includes a driving roller 76, a tension roller 20, four primary transfer rollers 74 (K, C, M, and Y), a secondary transfer roller 21, a belt cleaning device 71, a cleaning backup roller 72, and the like in addition to the intermediate transfer belt 22.

The intermediate transfer belt 22 serving as a belt member and a transfer belt is stretched by the driving roller 76, the tension roller 20, the cleaning backup roller 72, and the four primary transfer rollers 74 (K, C, M, and Y) that are arranged inside a loop of the intermediate transfer belt 22. The intermediate transfer belt 22 is then endlessly moved in a counter-clockwise direction in the drawing due to a rotational force of the driving roller 76 that is rotationally driven in the same direction by a driver (not illustrated).

Such an endlessly moved intermediate transfer belt 22 is sandwiched between the four primary transfer rollers 74 (K, C, M, and Y) and the photoconductors 24 (K, C, M, and Y). This sandwiching forms four primary transfer nips for K, C, M, and Y at which the front surface of the intermediate transfer belt 22 is in contact with the photoconductors 24 (K, C, M, and Y).

A primary transfer bias is applied to each of the primary transfer rollers 74 (K, C, M, and Y) by a transfer bias power supply (not illustrated). Accordingly, a transfer electric field is formed between the electrostatic latent image on the photoconductor 24 (K, C, M, and Y) and the primary transfer roller 74 (K, C, M, and Y). A transfer charger or a transfer brush may be adopted instead of the primary transfer roller 74.

Y toner formed on a surface of the photoconductor 24Y for yellow of the process unit 26Y for yellow enters the above-described primary transfer nip for Y according to the rotation of the photoconductor 24Y for yellow. At the primary transfer nip for Y, the Y toner is primary-transferred from the photoconductor 24Y for yellow to the intermediate transfer belt 22 due to actions of the transfer electric field and a nip pressure. To the intermediate transfer belt 22 to which a Y toner image is primary-transferred as described above, toner images of M, C, and K on the photoconductors 24 (M, C, and K) are primary-transferred while being sequentially overlapped with the Y toner image when the intermediate transfer belt 22 passes through the primary transfer nips for M, C, and K according to its endless movement. Such overlapping primary transfer causes a toner image of four colors to be formed on the intermediate transfer belt 22.

The secondary transfer roller 21 of the transfer unit 75 is arranged outside the loop of the intermediate transfer belt 22 to sandwich the intermediate transfer belt 22 between the secondary transfer roller 21 and the tension roller 20 inside the loop. This sandwiching forms a secondary transfer nip at which the front surface of the intermediate transfer belt 22 is in contact with the secondary transfer roller 21. A secondary transfer bias is applied to the secondary transfer roller 21 by a transfer bias power supply (not illustrated). This application causes a secondary transfer electric field to be formed between the secondary transfer roller 21 and the tension roller 20 that is grounded.

A sheet feeding cassette 41 housing a sheet bundle of a plurality of stacked recording sheets is arranged on a vertically lower side of the transfer unit 75 in a slidable and detachable manner with respect to a housing 101 of the printer 100. The sheet feeding cassette 41 causes a recording sheet on the top of the sheet bundle to be in contact with a sheet feeding roller 42, and rotates the sheet feeding roller 42 in a counter-clockwise direction in the drawing at predetermined timing to feed the recording sheet toward a sheet feeding path.

A registration roller pair 43 including two registration rollers is arranged near the termination of the sheet feeding path. Immediately after sandwiching a recording sheet as a recording member fed from the sheet feeding cassette 41 between the rollers, the registration roller pair 43 then stops rotation of both the rollers. The registration roller pair 43 then restarts rotational driving at timing when the sandwiched recording sheet can be synchronized with the toner image of four colors on the intermediate transfer belt 22 in the secondary transfer nip described above to feed the recording sheet toward the secondary transfer nip.

The toner image of four colors on the intermediate transfer belt 22 that is brought into close contact with the recording sheet at the secondary transfer nip is collectively secondarily transferred onto the recording sheet due to influence of the secondary transfer electric field and the nip pressure to make a full-color toner image in cooperation with white of the recording sheet. The recording sheet on the surface of which the full-color toner image is formed passes through the secondary transfer nip to be curvature-separated from the secondary transfer roller 21 and the intermediate transfer belt 22. The recording sheet is then fed to a fixing device 40 serving as a fixing unit via a carrying path after transfer.

Residual toner after transfer that has not been transferred to the recording sheet adheres to the intermediate transfer belt 22 that has passed through the secondary transfer nip. The residual toner is cleaned from a surface of the belt by the belt cleaning device 71 being in contact with the front surface of the intermediate transfer belt 22. The cleaning backup roller 72 arranged inside the loop of the intermediate transfer belt 22 backs up the cleaning of the belt by the belt cleaning device 71 from inside the loop.

The fixing device 40 includes a fixing roller 45 containing a heat generating source 45*a* such as a halogen lamp and a pressure roller 47 that rotates while being in contact with the fixing roller 45 under a certain pressure. A fixing nip is formed by the fixing roller 45 and the pressure roller 47. The recording sheet fed into the fixing device 40 is sandwiched at the fixing nip so that an unfixed toner image bearing surface is in close contact with the fixing roller 45. Thus, the toner in the toner image is softened due to influence of heating or pressurization, and a full-color image is fixed.

When a single-side print mode is set by an input operation through an operation part such as a numeric keypad (not illustrated) or a control signal transmitted from a personal computer and the like (not illustrated), the recording sheet ejected from the fixing device 40 is directly ejected to the outside of the apparatus. The recording sheet is then stacked on a stack part configured with an upper surface of an upper cover 56 of the housing 101.

According to the embodiment, a toner image formation unit that forms the toner image is configured of the four process units 26 (K, C, M, and Y) and the optical writing unit 27.

The upper cover 56 of the housing 101 of the printer 100 is pivotably supported around a shaft member 51 as indicated by an arrow A in FIG. 2, and rotates in a counter-clockwise direction in FIG. 2 to be in an opened state with respect to the housing 101 of the printer 100. Accordingly, an upper opening of the housing 101 of the printer 100 is widely exposed. The optical writing unit 27 is also pivotably supported around the shaft member 51. When the optical writing unit 27 is rotated in the counter-clockwise direction in FIG. 2, upper surfaces of the four process units 26 (K, C, M, and Y) can be exposed.

The process units 26 (K, C, M, and Y) are attached or detached by opening the upper cover 56 and the optical writing unit 27. Specifically, after the upper cover 56 and the optical writing unit 27 are opened to expose the upper surfaces of the process units 26 (K, C, M, and Y), the process units 26 (K, C, M, and Y) are pulled out in a vertically upward direction to be removed from the main body.

The process units 26 are frequently attached or detached by opening the upper cover 56 and the optical writing unit 27, so that an attaching/detaching operation can be checked by viewing inside the housing 101 from above without taking an uncomfortable posture such as squatting down, bending a waist, or crouching down. Accordingly, a work burden can be reduced or an operation error can be prevented.

Although the process unit 26 including the photoconductor unit 10 and the developing unit 23 can be attached to and detached from the main body of the printer 100 according to the embodiment, the developing unit 23 and the photoconductor unit 10 may be separately attached to and detached from the main body of the printer 100.

Figure 1:
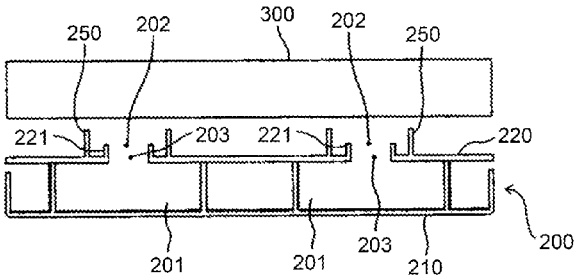
FIG. 1 is a schematic cross-sectional view of a sound absorbing device included in a printer.
Figure 4:
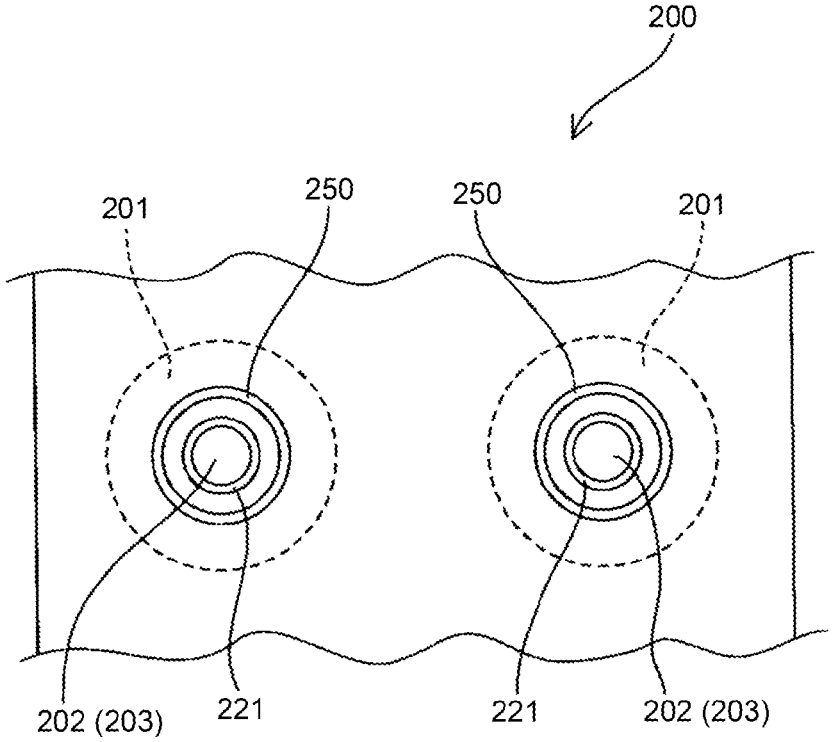
FIG. 4 is a top view of the sound absorbing device viewed from an upper side of FIG. 1.

FIG. 1 is a schematic cross-sectional view of a sound absorbing device 200 included in the printer 100. FIG. 4 is a top view of the sound absorbing device 200 viewed from an upper side of FIG. 1.

The sound absorbing device 200 utilizes a Helmholtz resonator, and is configured by joining a communicating part forming plate 220 and a cavity forming member 210. The communicating part forming plate 220 is a member that forms a wall surface on which a communicating part 203 is arranged for causing a cavity part 201 to communicate with the outside, among wall surfaces that form the cavity part 201 of the Helmholtz resonator. The cavity forming member 210 is a member that forms the wall surfaces of the cavity part 201 other than the wall surface formed with the communicating part forming plate 220. Examples of material for the communicating part forming plate 220 and the cavity forming member 210 can include resin material such as a polycarbonate resin or an ABS resin. However, the material is not limited thereto.

Next, the following describes a characteristic part of the present invention.

As illustrated in FIG. 1 and FIG. 4, the sound absorbing device 200 includes a projection part 250 that surrounds an opening 202 of the communicating part 203 formed with a flange part 221 protruding from an outer wall surface of the communicating part forming plate 220. In the embodiment, the projection part 250 has a cylindrical shape, but is not limited thereto so long as it has a shape surrounding the opening 202. In the embodiment, the projection part 250 surrounds the entire area)(360° around the opening 202. Alternatively, a gap may be formed on part of the projection part 250 so long as the projection part 250 has a shape that can prevent an air current from being generated around the opening 202.

In the configuration in which a gap is formed on part of the projection part 250, the projection part 250 surrounds an upstream side of a direction in which the air current, which may be generated in a space opposed to a surface of the communicating part forming plate 220, flows with respect to the opening 202. This configuration can prevent the air current from being generated around the opening 202 in a certain degree.

A distal end of the projection part 250 is arranged to be close to a surface of a sound source device 300 that generates sound that may be noise. Examples of the sound source device 300 may include a drive device including a driving motor and the optical writing unit 27 including a polygon motor or a polygon mirror.

Figure 5:
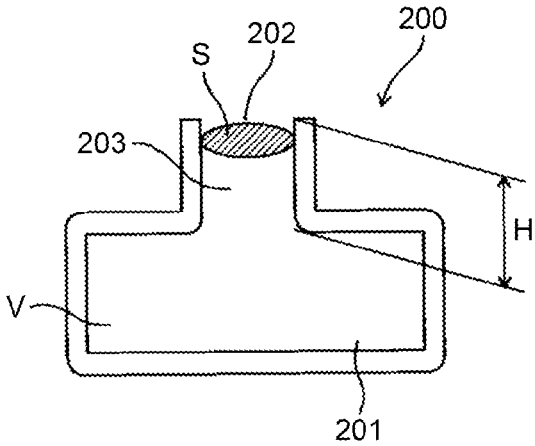
FIG. 5 is a schematic diagram of the sound absorbing device including a Helmholtz resonator.

FIG. 5 is a schematic diagram of the sound absorbing device 200 including the Helmholtz resonator.

As illustrated in FIG. 5, the Helmholtz resonator has a shape like a container having a narrowed mouth, includes the cavity part 201 having a certain volume and the communicating part 203 smaller than the cavity part 201, and absorbs the sound of a specific frequency entering the communicating part 203.

Assuming that the volume of the cavity part 201 is "V", a square measure of an opening of the communicating part 203 is "S", a length of the communicating part 203 is "H", the velocity of sound is "c", and a sound absorbing frequency in the sound absorbing device 200 is "f", the following expression (1) is established.

$$f = \frac{c}{2\pi}\sqrt{\frac{S}{V(H+\Delta r)}} \tag{1}$$

In the expression (1), "Δr" represents open end correction. In general, "Δr=0.6 r" is used when a radius of a circular cross section of the communicating part 203 is "r".

As represented by the expression (1), a frequency of the sound absorbed by the sound absorbing device 200 can be obtained using the volume V of the cavity part 201, the length H of the communicating part 203, and the square measure S of the opening of the communicating part 203.

In the printer 100, there are generated various sounds such as the driving sound of the driving motor that transmits rotational driving to various rollers, the moving sound of moving members such as various rollers, and the rotating sound of the polygon mirror of the optical writing unit 27. Such sounds may be transmitted to the outside of the printer 100 to be noise that makes neighboring people feel uncomfortable. The sound absorbing device 200 is formed corresponding to the frequency of a sound that should be prevented from being transmitted to the outside among the sounds that may be noise, so that the sound absorbing device 200 can absorb the sound that may be noise.

Figure 6:
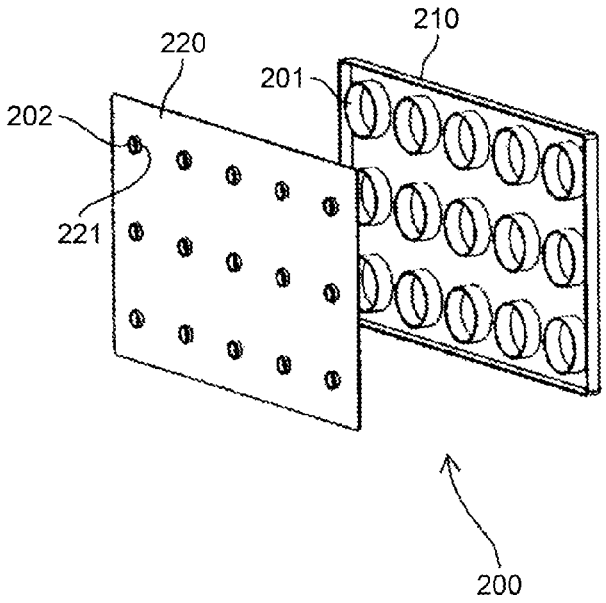
FIG. 6 is an exploded perspective view of the sound absorbing device including no characteristic part of the present invention.
Figure 7:
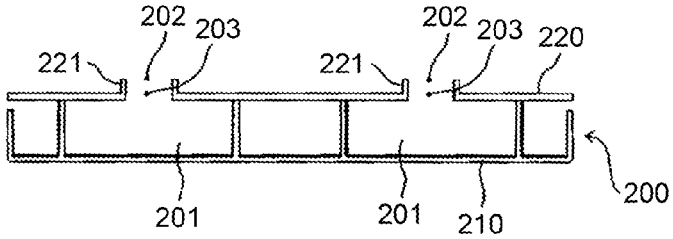
FIG. 7 is a schematic cross-sectional view of the sound absorbing device including no characteristic part of the present invention.

FIGS. 6 and 7 are explanatory diagrams of a configuration of the sound absorbing device 200 including the Helmholtz resonator having no characteristic part of the present invention. FIG. 6 is an exploded perspective view of the sound absorbing device 200. FIG. 7 is a schematic cross-sectional view of the sound absorbing device 200. The communicating part forming plate 220 is joined to the cavity forming member 210 to form a resonance box including the cavity part 201, and a hole formed on the communicating part forming plate 220 serves as the communicating part 203.

Some image forming apparatuses such as the printer 100 include an exterior cover such as the upper cover 56 that is opened when a user replaces a replaceable unit and an interior cover that covers the inside of the exterior cover to prevent the inside of the apparatus from being exposed even when the exterior cover is opened.

When the communicating part forming plate 220 is formed on part of the interior cover having such a configuration or the cavity forming member 210 is formed on part of the exterior cover, the number of components can be reduced. A configuration may be considered such that the communicating part forming plate 220 is formed on the interior cover and the cavity forming member 210 is formed on the exterior cover to join the cavity forming member 210 on the exterior cover to the communicating part forming plate 220 on the interior cover when the opened exterior cover is closed. However, when the cavity forming member 210 and the communicating part forming plate 220 are formed on members to be in contact with or separated from each other due to an opening/closing operation of the exterior cover, a sealing property of the cavity part 201 is hardly secured. A low sealing property of the cavity part 201 reduces a sound absorbing effect of the sound absorbing device 200, so this configuration is not practical.

A practical configuration is such that the cavity forming member 210 separated from the exterior cover is joined to the interior cover on which the communicating part forming plate 220 is formed, or the communicating part forming plate 220 separated from the interior cover is joined to the exterior cover on which the cavity forming member 210 is formed. If the sealing property of the cavity part 201 can be secured in a state in which the exterior cover is closed, it is preferred that the communicating part forming plate 220 be formed on the interior cover and the cavity forming member 210 be formed on the exterior cover in view of reducing the number of components.

The communicating part forming plate 220 may be formed on part of a main body structure arranged inside the interior cover. However, the main body structure is easily affected by vibration because many components that may be vibration sources are mounted thereon.

The main body structure, the exterior cover, and the interior cover are arranged at fixed positions in an apparatus main body, so that a distance between the sound source device and the sound absorbing device including the Helmholtz resonator is necessarily fixed. If the distance is long, a silencing effect is hardly exhibited.

In the sound absorbing device 200 illustrated in FIGS. 6 and 7, there is no obstruction to air flow around the opening 202 of the communicating part 203, so that an air current may be generated around the opening 202. When the air current is generated around the opening 202, air in the communicating part 203 is moved to disturb resonance, which reduces the sound absorbing effect of the sound absorbing device 200 including the Helmholtz resonator.

In contrast, in the sound absorbing device 200 according to the embodiment illustrated in FIGS. 1 and 4, the projection part 250 surrounds the opening 202 to prevent the air current from being generated around the opening 202. This configuration prevents reduction in the sound absorbing effect due to the air current around the opening 202, so that the sound can be efficiently absorbed. The distal end of the projection part 250 in the sound absorbing device 200 is arranged to be close to the sound source device 300, which can prevent air from entering around the opening 202 and prevent the air current from being generated around the opening 202.

Figure 8:
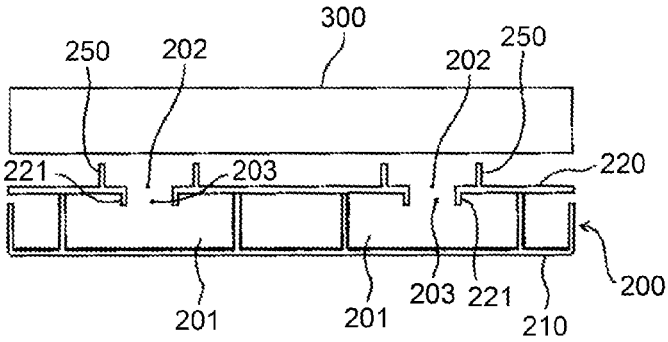
FIG. 8 is a schematic cross-sectional view of the sound absorbing device in which a communicating part is arranged at an inner side of a cavity part.

FIG. 8 is a schematic cross-sectional view of the sound absorbing device 200 in which the communicating part 203 is arranged at an inner side of the cavity part 201 than the communicating part forming plate 220. In the sound absorbing device 200 illustrated in FIG. 8, the flange part 221 forming the communicating part 203 protrudes toward the inner side of the cavity part 201 than a plane of the communicating part forming plate 220. Even in such a configuration, the same frequency as that in the configuration of FIG. 1 can be absorbed if the volume V of the cavity part 201, the square measure S of the opening 202 of the communicating part 203, and the length H of the communicating part 203 are the same. In the configuration illustrated in FIG. 8, the opening 202 of the communicating part 203 is at the same height as the plane of the communicating part forming plate 220. Accordingly, the height of the projection part 250 surrounding the opening 202 can be reduced as compared with the configuration illustrated in FIG. 1 in which the opening 202 is at a position higher than the plane of the communicating part forming plate 220. Thus, the sound absorbing device 200 can be brought closer to the sound source device 300 to improve sound absorbing efficiency.

Figure 9:
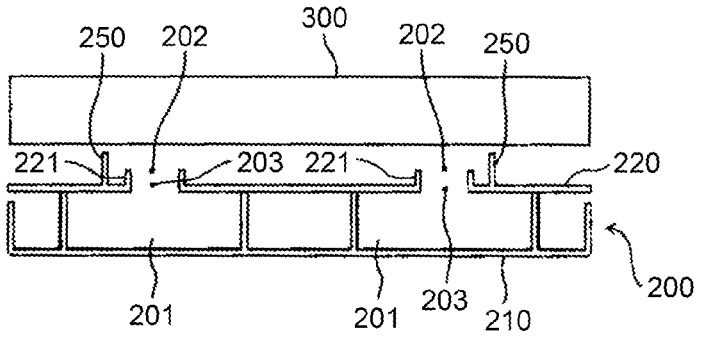
FIG. 9 is a schematic cross-sectional view of the sound absorbing device in which one projection part surrounds a plurality of adjacent openings.

In the sound absorbing device 200 illustrated in FIGS. 1 and 4, one cylindrical projection part 250 surrounds one opening 202. However, the projection part 250 may be configured to surround a plurality of adjacent openings 202 as illustrated in FIG. 9.

Figure 10:
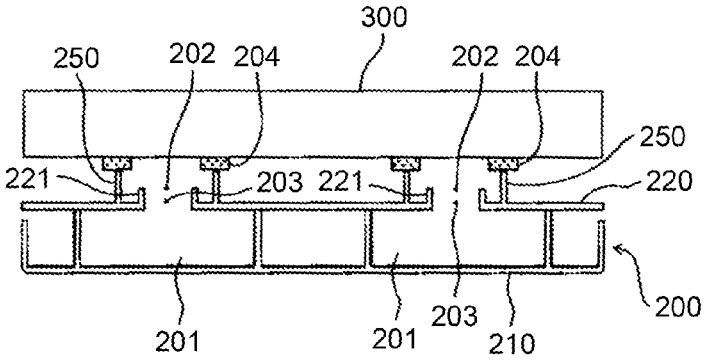
FIG. 10 is a schematic cross-sectional view of the sound absorbing device including a sealing member.

FIG. 10 is a schematic cross-sectional view of a configuration including a sealing member 204 serving as a variable member that is sandwiched and pressurized between the distal end of the projection part 250 of the sound absorbing device 200 and the surface of the sound source device 300, and is deformed along the projection part 250 and the surface of the sound source device 300 to close a gap. By providing the sealing member 204, an area surrounded by the projection part 250 can be sealed, the air can be prevented from entering around the opening 202, and the air current can be prevented from being generated around the opening 202. Sound leakage from a gap between the projection part 250 and the sound source device 300 can be prevented, so that the sound absorbing efficiency can be improved.

Examples of the sealing member 204 may include an elastic body such as rubber. Alternatively, a member made of such as clay, which is kept deformed even when pressurization is released, may be employed instead of such an elastic body, which is restored when the pressurization is released after deformation, so long as it is deformed when the communicating part forming plate 220 is joined to the cavity forming member 210 to seal a joining part.

Figure 11:
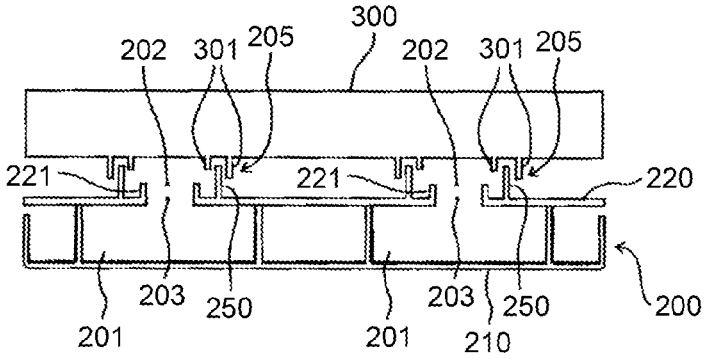
FIG. 11 is a schematic cross-sectional view of the sound absorbing device having a labyrinth shape.

FIG. 11 is a schematic cross-sectional view of a configuration in which a labyrinth shape 205 is formed between the projection part 250 of the sound absorbing device 200 and the surface of the sound source device 300. In the configuration illustrated in FIG. 11, a projection 301 on the sound source device side is arranged on the surface of the sound source device 300 on an inner peripheral surface side and an outer peripheral surface side of the cylindrical projection part 250. This configuration makes a path through which the air may pass at a position where the projection part 250 faces the surface of the sound source device 300 be a complicated shape (labyrinth shape 205). Such a labyrinth shape 205 thus formed can prevent the air from entering around the opening 202 and prevent the air current from being generated around the opening 202 without adding a component such as the sealing member 204 having the configuration illustrated in FIG. 10. In addition, the labyrinth shape 205 may insulate the sound, so that the sound leakage from the gap between the projection part 250 and the sound source device 300 can be prevented and the sound absorbing efficiency can be improved.

In addition, when the projection part surrounds the opening 202, it is not necessary to form the projection part at the Helmholtz resonator side. For example, in FIG. 11, at least one of the projections 301 formed at the sound source device side may be configured to surround the opening 202.

Devices serving as the sound source device 300 may often generate heat in driving. If a space between the surface of the sound source device 300 and the opening 202 is sealed as illustrated in FIG. 10, the air in the sealed space cannot move and is continuously heated by the heat generated by the sound source device 300 in driving, which causes heat accumulation. When a temperature of the air in the space opposed to the opening 202 is raised by being continuously heated, the communicating part forming plate 220 made of resin may be deformed by the heat. In contrast, in the configuration including the labyrinth shape 205 as illustrated in FIG. 11, the heated air can be released from a gap of the labyrinth shape 205, so that the heat can be prevented from being accumulated in the space opposed to the opening 202 as compared with the configuration illustrated in FIG. 10.

The embodiment has described a case in which the electronic device including the sound absorbing device is the image forming apparatus. Alternatively, the present invention can be applied to an electronic device other than the image forming apparatus so long as it includes a sound source part that generates sound when in operation and a sound absorbing device that absorbs the sound generated by the sound source part.

The above description is exemplary only, and the present invention exhibits a specific effect for each aspect as follows.

Aspect A

A sound absorbing device such as the sound absorbing device 200 including the Helmholtz resonator includes a projection part such as the projection part 250 that has a shape of protruding from an outer wall surface of a cavity part forming member such as the communicating part forming plate 220 and the cavity forming member 210 forming a cavity part of the Helmholtz resonator such as the cavity part 201, and surrounding an opening such as the opening 202 of a communicating part such as the communicating part 203 that causes the cavity part to communicate with the outside.

As described in the above embodiment, the projection part surrounds the opening, and this configuration can prevent the air current from being generated around the opening, and prevents reduction in the sound absorbing effect due to the air current around the opening, so that the sound can be efficiently absorbed.

Aspect B

In an electronic device including a sound source device such as the sound source device 300 that generates sound when in operation and a sound absorber that absorbs the sound, a sound absorbing device such as the sound absorbing device 200 according to the aspect A is used as the sound absorber.

As described in the above embodiment, this configuration prevents reduction in the sound absorbing effect of the sound generated when the electronic device is operated due to the air current around the opening, so that the sound can be efficiently absorbed.

Aspect C

A sound absorbing device such as the sound absorbing device 200 in aspect B resonates with at least one frequency of the sound generated by a sound source device such as the sound source device 300.

As described in the above embodiment, this configuration enables the sound of resonance frequency to be absorbed and can reduce the sound generated in the electronic device that may be noise.

Aspect D

In the electronic device according to any of the aspects B and C, a distal end of a projection part such as the projection part 250 of a sound absorbing device such as the sound absorbing device 200 is arranged to be close to a sound source device such as the sound source device 300.

As described in the above embodiment, the sound absorbing device is arranged to be close to the sound source device, so that the sound that may be noise generated in the electronic device such as the printer 100 can be efficiently reduced.

Aspect E

The electronic device according to the aspect D includes a variable member such as the sealing member 204 that is sandwiched and pressurized between a distal end of a projection part such as the projection part 250 of a sound absorbing device such as the sound absorbing device 200 and a surface of a sound source device such as the sound source device 300, and is deformed along the projection part and the surface of the sound source device.

As described in the above embodiment, this configuration causes an area surrounded by the projection part to be sealed, prevents air from entering around an opening such as the opening 202, and prevents an air current from being generated around the opening. This configuration also prevents sound leakage from a gap between the projection part and the sound source device to improve sound absorbing efficiency. Accordingly, the sound that may be noise generated in the electronic device such as the printer 100 can be efficiently reduced.

Aspect F

The electronic device according to the aspect D includes a labyrinth shape such as the labyrinth shape 205 between a distal end of a projection part such as the projection part 250 of a sound absorbing device such as the sound absorbing device 200 and a surface of a sound source device such as the sound source device 300.

As described in the above embodiment, this configuration can efficiently reduce the sound that may be noise generated in the electronic device such as the printer 100 without adding any component.

Aspect G

An electronic device such as the printer 100 including a sound source device such as the sound source device 300 that generates sound when in operation and a sound absorbing device such as the sound absorbing device 200 including the Helmholtz resonator includes a shape such as the projection part 250 surrounding an opening such as the opening 202 of a communicating part such as the communicating part 203 that causes a cavity part such as the cavity part 201 of the Helmholtz resonator to communicate with the outside.

As described in the above embodiment, the shape surrounding the opening can prevent the air current from being generated around the opening, and prevents reduction in the sound absorbing effect due to the air current around the opening, so that the sound can be efficiently absorbed.

In the above embodiment, the projection part as the shape surrounding the opening is arranged on an outer surface of the sound absorbing device. Alternatively, the shape surrounding the opening may be formed on another member arranged around the sound absorbing device.

Aspect H

An electrophotographic image forming apparatus such as the printer 100 includes the configuration of the electronic device according to any of the aspects B to G.

As described in the above embodiment, this configuration prevents reduction in the sound absorbing effect of the sound generated when the image forming apparatus is operated due to the air current around the opening, so that the sound can be efficiently absorbed.

The present invention exhibits an excellent effect such that the sound absorbing device including the Helmholtz resonator prevents reduction in the sound absorbing effect due to the air current around the opening to absorb the sound efficiently.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sound absorbing device including a Helmholtz resonator that absorbs sound generated from a sound source, the sound absorbing device comprising:

an outer wall surface of a cavity part forming member that forms a cavity part of the Helmholtz resonator, a flange part that configures a communicating part through which the cavity part is communicated with outside; and a projection part placed at a periphery of an opening of the flange part, the opening being formed at a side of the flange part near the sound source.

2. An electronic device comprising:

a sound absorber that absorbs sound, the sound absorber being the sound absorbing device according to claim 1.

3. The electronic device according to claim 2, wherein the sound absorbing device resonates with at least one frequency of the sound generated in the sound source device.

4. The electronic device according to claim 2, wherein a distal end of the projection part of the sound absorbing device is arranged to be close to the sound source device.

5. The electronic device according to claim 4, further comprising:

a variable member that is sandwiched and pressurized between the distal end of the projection part of the sound absorbing device and a surface of the sound source device and is deformed along the projection part and the surface of the sound source device.

6. The electronic device according to claim 4, further comprising:

a labyrinth shape between the distal end of the projection part of the sound absorbing device and the surface of the sound source device.

7. An electronic device comprising:

a sound source device that generates sound when in operation and a sound absorbing device including a Helmholtz resonator, wherein the Helmholtz resonator includes a flange part through which a cavity part of the Helmholtz resonator is communicated with outside; and a projection part is formed at a periphery of an opening of the flange part, the opening being formed at a side of the flange part near the sound source, and the projection part extending from the flange part toward the Helmholtz resonator.

8. An electrophotographic image forming apparatus comprising:

the configuration of the electronic device according to claim 7.

9. A sound absorbing device including a Helmholtz resonator that absorbs sound generated from a sound source, the sound absorbing device comprising:

an outer wall surface of a cavity part forming member that forms a cavity part of the Helmholtz resonator; and a flange part that configures a communicating part through which the cavity part is communicated with outside wherein a projection part is formed at a periphery of an opening of the flange part, the opening through which the sound generated from the sound source propagates into the cavity part of the Helmholtz resonator.

* * * * *